US010264930B2

(12) United States Patent
Stenberg et al.

(10) Patent No.: US 10,264,930 B2
(45) Date of Patent: Apr. 23, 2019

(54) DISPENSER FOR INTERFOLDED NAPKINS

(71) Applicant: SCA Hygiene Products AB, Göteborg (SE)

(72) Inventors: Martin Stenberg, Torslanda (SE); Jan Lundgren, Malmö (SE); Mårten Rittfeldt, Skanör (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 105 days.

(21) Appl. No.: 15/039,431

(22) PCT Filed: Dec. 9, 2013

(86) PCT No.: PCT/SE2013/051470
§ 371 (c)(1),
(2) Date: May 26, 2016

(87) PCT Pub. No.: WO2015/088398
PCT Pub. Date: Jun. 18, 2015

(65) Prior Publication Data

US 2016/0374524 A1 Dec. 29, 2016

(51) Int. Cl.
*A47K 10/42* (2006.01)
*B65D 83/08* (2006.01)
*A47K 10/32* (2006.01)

(52) U.S. Cl.
CPC ..... *A47K 10/422* (2013.01); *B65D 83/0817* (2013.01); *A47K 2010/3233* (2013.01)

(58) Field of Classification Search
CPC ..... A47K 10/22; A47K 2010/3233; B65D 83/0817

(Continued)

(56) References Cited

U.S. PATENT DOCUMENTS 2,253,742 A * 8/1941 West ..... A47K 10/422 221/52
2,849,153 A * 8/1958 Tuttle ..... A47K 10/422 221/154

(Continued)

FOREIGN PATENT DOCUMENTS

CN 1232432 A 10/1999
CN 1247049 A 3/2000

(Continued)

OTHER PUBLICATIONS

Extended European Search Report dated May 22, 2017 in European Patent Application No. 13899292.0.

(Continued)

*Primary Examiner* — Rakesh Kumar
(74) *Attorney, Agent, or Firm* — Drinker Biddle & Reath LLP

(57) ABSTRACT

The present disclosure relates to a dispenser for interfolded napkins, including an inner container defining a dispensing opening, and an outer sleeve including a dispensing mouth. The outer sleeve forms at least one open end portion being arranged to receive the inner container, and the dispensing mouth forms an open end towards an open end portion of the sleeve. When the inner container is located in the outer sleeve, a supporting surface is biased towards the dispensing opening of the inner container and vertically movable inside the inner container between a lower position and an upper position, and, at least in a region adjacent the open end of the dispensing mouth, the outer contour of the upper ends of the side walls of the inner container deviates from the inner periphery of the sleeve, forming an access opening to the space between the upper position and the dispensing mouth.

24 Claims, 6 Drawing Sheets

(58) Field of Classification Search
USPC ..... 221/59
See application file for complete search history.

(56) References Cited

U.S. PATENT DOCUMENTS

| | | | | |
|---|---|---|---|---|
| 3,168,275 | A * | 2/1965 | Grondin | A47K 10/185 108/152 |
| 3,245,580 | A * | 4/1966 | Campanella | B65D 5/38 221/34 |
| 3,258,238 | A * | 6/1966 | Grafton | A47K 10/185 248/311.3 |
| 3,840,146 | A * | 10/1974 | Bodek | A47K 10/422 221/244 |
| 4,653,666 | A * | 3/1987 | Mertens | B42D 5/005 221/45 |
| 5,509,571 | A | 4/1996 | Weber | |
| 5,810,200 | A | 9/1998 | Trokhan | |
| 6,250,495 | B1 | 6/2001 | Bando | |
| 6,672,474 | B2 | 1/2004 | May et al. | |
| 6,749,084 | B2 * | 6/2004 | Thompson | B42D 5/005 221/56 |
| 7,004,435 | B2 * | 2/2006 | Formon | A47K 10/185 206/233 |
| 7,178,689 | B2 * | 2/2007 | Wieser | A47K 10/422 221/45 |
| 7,661,553 | B2 * | 2/2010 | Zeiron | A47K 10/427 221/305 |
| 2006/0175222 | A1 * | 8/2006 | Holland | A47K 10/185 206/494 |
| 2006/0273102 | A1 | 12/2006 | Wieser et al. | |
| 2011/0297692 | A1 | 12/2011 | Conway et al. | |
| 2011/0315707 | A1 * | 12/2011 | Kleinhuber | A47K 10/185 221/155 |

FOREIGN PATENT DOCUMENTS

| | | | |
|---|---|---|---|
| KR | 20100099457 | A * | 9/2010 |
| KR | 20100099457 | A | 9/2010 |
| WO | WO-2004/093629 | A1 | 11/2004 |
| WO | WO-2006/132618 | A1 | 12/2006 |
| WO | WO-2010/102674 | A1 | 9/2010 |
| WO | WO-2011/152867 | A1 | 12/2011 |
| WO | WO-2013/064165 | A2 | 5/2013 |

OTHER PUBLICATIONS

Decision on Grant dated Sep. 6, 2017 in Russian Patent Application No. 2016127306/12 (10 pages) with an English translation (7 pages).

First Chinese Office Action dated Feb. 24, 2018 issued in corresponding Chinese patent application No. 201380081465.8 (8 pages) and its English-language translation thereof (8 pages).

Colombian Office Action Oficio N° 16658 dated Dec. 20, 2017 issued in corresponding Colombian patent application No. 16139829 (4 pages) and its partial English-language translation thereof (7 pages).

* cited by examiner

DISPENSER FOR INTERFOLDED NAPKINS

CROSS-REFERENCE TO PRIOR APPLICATION

This application is a § 371 National Stage Application of PCT International Application No. PCT/SE2013/051470 filed Dec. 9, 2013, which is incorporated herein in its entirety.

TECHNICAL FIELD

The present disclosure relates to a dispenser for interfolded napkins. The dispenser includes an inner container having a bottom wall extending in a horizontal plane, side walls extending from the bottom wall in a vertical direction perpendicular thereto, and a dispensing opening opposite the bottom wall. The side walls of the inner container surround a supporting surface for supporting a stack of interfolded napkins, and an outer sleeve comprising a dispensing mouth. The outer sleeve forming at least one open end portion being arranged to receive the inner container such that the inner container is insertable into the outer sleeve along an insertion direction extending in parallel to said horizontal plane, and that, when in position inserted in the outer sleeve, the dispensing opening of the container is aligned with the dispensing mouth of the outer sleeve.

BACKGROUND

Napkins in the form of sheets of material intended for wiping and for hygienic purposes are common household items that may be provided in the form of stacks of napkins from which individual napkins can be readily removed when needed. The dispenser for the napkins should be easy to handle, should protect the napkins until use and should be easy to move to a location where the napkins are needed, such as to a table, a counter, etc.

A common type of dispenser for this kind of napkins is an open cardboard box in which the napkins are arranged in a stack standing on an edge of the napkins with part of the napkins protruding through the opening in the box to provide grippability. This is a simple and inexpensive way of dispensing the napkins. However, the protruding parts of the napkins tend to fold over the edge of the box and become ruffled and deformed.

Moreover, as soon as a few napkins have been removed from the box, the remaining stack does not fill the width of the container with the result that the stack may buckle inside the box.

A further commonly used option is to arrange the napkins in an interfolded stack which is placed standing on a bottom surface in a container having a dispensing opening at the top of the container. The napkins are then successively removed from the top of the stack through the dispensing opening.

Interfolded napkins are sheets of materials arranged in a stack of superposed sheets which are each folded at least once. The sheets are interlinked in such a way that the separate folded sheets of material form a chain of sheets where each sheet has a leading panel and a trailing panel, the trailing panel being at least partly overlapped with the leading panel of the subsequent sheet in the stack. In this manner, the individual sheets are held loosely together by means of frictional forces arising between the overlapping parts. The sheets may be dispensed from a dispenser by pulling at the leading panel of the first sheet in the stack. In this manner, the first material sheet is extracted at the same time as a predetermined part of the leading panel of a subsequent material sheet is fed into a dispensing position in the dispenser.

The dispenser usually has a lid or cover with a dispensing opening that restricts the width of the dispensed napkin in order to keep the leading panel of the next napkin to be dispensed from falling back into the dispenser.

WO2010/102674 describes a dispenser for tissue paper comprising an inner core and an outer shell, each having a dispensing opening. When the inner core is received in the outer shell, the respective dispensing openings are aligned. The inner core is insertable into the outer shell in a direction perpendicular to the dispensing opening.

In WO2010/102674, for use of the dispenser, a first napkin must be pulled from the top end of the stack and through the dispensing mouth. This procedure might be difficult and often results in a wrinkled napkin.

WO2011/152867 describes a dispenser including a holder for receiving a refill container including a stack of sheets. The refill container includes opposed first and second flaps extending over a top surface of the stack and defining a longitudinal dispensing slot between them.

In WO 2011/152867, the leading end of an uppermost sheet in the stack will be presented to a user lying flatly down over one of the first and second flaps.

In view of the prior art, there is still a need for improvement when it comes to providing a dispenser which allows for a user-friendly presentation of napkins to a user.

It is desired to provide an improved or alternative dispenser for dispensing interfolded napkins.

SUMMARY

A dispenser as described herein includes an inner container having a bottom wall extending in a horizontal plane, and side walls extending from the bottom wall in a vertical direction perpendicular thereto and defining a dispensing opening opposite the bottom wall. The side walls of the inner container surround a supporting surface for supporting a stack of interfolded napkins, and an outer sleeve including a dispensing mouth, the outer sleeve forming at least one open end portion being arranged to receive the inner container such that the inner container is insertable into the outer sleeve along an insertion direction extending in parallel to said horizontal plane, and that, when inserted in the outer sleeve, the dispensing opening of the container is aligned with the dispensing mouth of the outer sleeve.

Moreover, the supporting surface is vertically movable inside the inner container between a lower position adjacent the bottom wall of the inner container, and an upper position adjacent the dispensing opening of the inner container. The supporting surface is biased towards the dispensing opening of the container, the dispensing opening and the dispensing mouth both extend along said insertion direction, and the dispensing mouth is open towards said open end portion of the sleeve.

The upper position may be located a distance from the inner periphery of the outer sleeve, forming a space between the upper position and the dispensing mouth.

At least in a region adjacent the open end of the dispensing mouth, the outer contour of the upper ends of the side walls of the inner container may deviate from the inner periphery of the sleeve, forming an access opening to the space between the tabs and the dispensing mouth, when the inner container is located inside the outer sleeve.

The upper position may be determined by at least one horizontally extending tab arranged in the inner container.

Hence, in use, the supporting surface or the uppermost napkin of a stack positioned on the supporting surface will abut the horizontally extending tab.

In such a dispenser, when a stack of napkins, supported by the supporting surface and arranged with a top surface abutting said tabs, and having a leading end extending along said insertion direction and protruding from said dispensing opening is positioned in said inner container, said leading end is positioned inside the dispensing mouth upon insertion of the container into the sleeve along said insertion direction.

Accordingly, since the dispensing mouth is open at least towards the open end of the outer sleeve, the dispenser may easily be set up with a first napkin extending through the dispensing mouth.

To this end the inner container, when located outside of the outer sleeve, is first wholly or partly filled with a stack of napkins. A leading end of a top napkin in the stack is gripped and allowed to extend through the dispensing opening in the container. Then, as the inner container is introduced into the outer sleeve by introduction along the insertion direction, the leading end of the top napkin is threaded into the dispensing opening. Accordingly, the dispenser is easily set-up and ready for use with a leading end of a first napkin extending from the dispensing opening.

Moreover, an access opening to a space between the upper position of the supporting surface and the dispensing mouth of the sleeve may be provided. Such an access opening is useful in that it provides a further possibility to arrange a leading end of a stack inside the dispensing mouth of the container, namely by, when the inner container is already in position in the outer sleeve, grasping the leading end of the uppermost napkin in the stack, and introducing it into the dispensing mouth of the outer sleeve.

From the above, it will be understood that that the upper position of the vertically movable supporting surface, is located at a distance from the inner periphery of the outer sleeve, such that a space is formed between the upper position of the supporting surface and the dispensing mouth of the sleeve, enables the use of both possibilities for introduction of a leading end of a stack.

In practical circumstances, it might be that the method where the leading end of the stack is introduced via the open end of the dispensing mouth of the sleeve upon introduction of the inner container in the sleeve is preferred for example when the dispenser is refilled with new napkins. The other method might be preferred if the feeding of napkins from the dispenser is interrupted, for example because two subsequent napkins in the stack are not properly interfolded. (Such interruptions may occur for example if the dispenser has been filled with more than one stack of interfolded napkins.) In this case, a user might prefer to use the access opening formed between the uppermost end portions of the inner container and the inner contour of the outer sleeve to grasp the uppermost napkin and introduce it into the dispensing mouth.

As used herein, the term "dispensing opening" means a portion of a container being open towards the ambient and being used for providing access to the inner space of the container.

As used herein, the term "dispensing mouth" means an opening through which items are dispensed.

Herein, by the term "adjacent" is meant items being nearest in space or position, immediately adjoining without intervening space, touching; and also items being near or close but not necessarily touching.

The present disclosure provides a dispenser for interfolded napkins which substantially eliminates the drawbacks of the dispensers discussed above.

Disclosed herein is a dispenser for interfolded napkins.

The dispenser includes an inner container having a bottom wall extending in a horizontal plane, and side walls extending from the bottom wall in a vertical direction perpendicular thereto and defining a dispensing opening opposite the bottom wall.

The inner container is intended to receive a stack of napkins to be dispensed from the dispenser. Accordingly, the shapes and dimensions of the inner container may be adapted to fit an intended stack.

In particular embodiments, the bottom wall has a generally rectangular shape, corresponding to the shape of the stack of napkins to be introduced into the container. Slight deviations from the general shape such as rounded corners etc. are conceivable. As used herein, the term "rectangular" is to include all four-sided plane figures with four substantially right angles.

The side walls of the container extend perpendicular to the plane of the bottom wall of the container, and perpendicular to the supporting surface.

The side walls delimit the container space and the size of the dispensing opening and are arranged to contain and support the stack of interfolded napkins without deforming the napkins. The side walls hence also provide side support for the stack of napkins, when the container is in use.

For the stack to be supported in horizontal directions, the side walls should extend vertically so as to surround and support the stack around the rectangular periphery thereof. To this end, it is necessary that the side walls have a certain extension along the periphery of the bottom surface. However, it will be understood that the side walls need not form a closed wall surface, but could be provided with openings or slots, if desired. Alternatively, the side walls could be formed by a number of ribs arranged vertically and at a distance from each other.

In a certain alternative, the side walls form closed side walls at least along two opposing side walls corresponding to the open ends of the sleeve. Accordingly, when the inner container is introduced in the sleeve, the dispenser as a whole may form an essentially closed compartment for protecting the stack of napkins.

In another alternative, the side walls form essentially closed side walls along the full perimeter of the bottom wall. Accordingly, the inner container will assume a box shape, being open upwardly at the dispensing opening.

A supporting surface is arranged surrounded by the side walls, and being movable inside the inner container between a lower position adjacent the bottom wall, and an upper position adjacent the dispensing opening.

Advantageously, the supporting surface is generally rectangular to support a stack of napkins. The outline of the supporting surface should be received between the side walls, such that the side walls may guide the supporting surface during its movement between the lower and upper positions.

The outline of the supporting surface may be provided with one or more protrusions protruding from said outline in the horizontal direction. Advantageously, said protrusions protrude into vertically arranged rails provided on one or more side walls of the inner container, to guide the vertical movement of the supporting surface between the lower and upper positions inside the inner container.

In particular embodiments, the support surface forms a generally complete surface, i.e. an entire wall. It is also conceivable to form the support surface using e.g. ribs or ledges being interconnected for supporting the stack of napkins.

As mentioned above, the side walls define the dispensing opening arranged at the upper portion of the dispenser. The dispensing opening in the context of embodiments of the present invention is a part of the container being open towards the ambient and providing access to the inner space of the container. Hence, the inner container may be filled with napkins by introduction thereof via the dispensing opening.

Advantageously, the outline of the dispensing opening will generally correspond to the shape of the supporting surface. This will provide a relatively large opening, which may easily be refilled with napkins.

In addition, the dispenser includes an outer sleeve including a dispensing mouth, the outer sleeve forming at least one open end portion being arranged to receive the inner container such that the inner container is insertable into the outer sleeve along an insertion direction extending in parallel to said horizontal plane. Advantageously, when inserted in the outer sleeve, the dispensing opening of the container is aligned with the dispensing mouth of the outer sleeve.

The outer sleeve includes a dispensing mouth, i.e. an opening through which items are dispensed. The dispensing mouth will be positioned over the items inside the container, so as to be aligned with a leading end of the stack of napkins, when the inner container is located inside the outer sleeve.

The dispensing mouth is open at least towards the open end of the outer sleeve. Accordingly, the dispenser may easily be set up with a first napkin extending through the dispensing mouth in accordance with the following:

First, the inner container, when located outside of the outer sleeve, is filled with a stack of napkins. A leading end of a top napkin in the stack is gripped and allowed to extend through the dispensing opening in the container. Then, as the inner container is introduced into the outer sleeve by introduction along the insertion direction (D), the leading end of the top napkin is threaded into the dispensing opening. Accordingly, the dispenser is easily set-up and ready for use with a leading end of a first napkin extending from the dispensing opening.

Advantageously, the outer sleeve forms two opposite open end portions, and the dispensing mouth is open towards both open end portions, such that the inner container is insertable into the outer sleeve along two opposing insertion directions.

In particular embodiments, the length of the outer sleeve along the insertion direction substantially corresponds to the length of the inner container along the insertion direction.

By means of the dispensing mouth, fall-back of the gripping portion of the uppermost napkin in a stack of interfolded napkins is avoided without the risk of the tearing or wrinkling of the napkin being pulled out or of the subsequent napkin. The dispenser arrangement proposed herein will also enable that only one napkin is dispensed at a time. Napkins may easily be withdrawn from the dispenser using only one hand, and the dispenser may be designed with a simple and reliable construction.

Expressed in relation to the longitudinal extension of the supporting surface of the container, the dispensing mouth may have a longitudinal extension of at least 75%, at least 85%, or at least 90% of the longitudinal extension of the supporting surface extending between the side walls. Also, the longitudinal extension of the dispensing mouth may be 100% of the longitudinal extension of the supporting surface, i.e. the longitudinal extension of the dispensing mouth is equal to the longitudinal extension of the supporting surface. In this case, the dispensing mouth may advantageously be open towards two opposing open ends of the sleeve.

Advantageously, the dispensing mouth may include vertically upwardly protruding edges, for supporting a leading end of a napkin when present in the dispensing opening. Such upwardly protruding edges may provide additional support to a leading end of the napkin present in the dispensing mouth, enabling the napkin to assume an up-right position.

The dispensing mouth may moreover at least partly have a selected width in a horizontal direction perpendicular to the insertion direction, said width being in the range 1-3 cm.

The width of the dispensing mouth should be sufficient for a napkin to easily pass therethrough.

Moreover, the dispensing mouth may be provided with at least one portion having a greater width than the other portions of the dispensing mouth. For example, such a portion could be arranged at the centre of the dispensing mouth. The portion with a greater width could be designed so as to facilitate gripping of the napkin. Also, a sufficiently great width may be provided to enable gripping of a first leading end of the uppermost napkin in a stack introduced in the dispenser, when the leading end is laying flatly down on the uppermost surface of the stack.

Further, it may still be desired to maintain portions of the dispensing mouth with a relatively narrow width, e.g. the portions of the dispensing mouth positioned adjacent to the open end(s) of the container, since such portions may support a leading end protruding through the dispensing mouth, such that the leading end is presented in an upright position for a user to grasp.

The dispensing mouth may have any suitable shape, such as oval or rectangular, provided that the dispensing mouth does not crease or in other way damage the napkin to be dispensed, and that the dispensing mouth provides sufficient support for the leading end of the napkin, such that the leading end of the napkin is in its upright position prior to use. As described in the above, advantageously, at least in a region adjacent the open end of the dispensing mouth, the outer contour of the upper ends of the side walls of the inner container may deviate from the inner periphery of the sleeve, forming an access opening to the space between the upper position and the dispensing mouth, when the inner container is located inside the outer sleeve.

The access opening may be obtained e.g. by an entire side wall of the inner container having a lesser vertical height than the corresponding portion of the outer sleeve.

Alternatively, the access opening may instead be obtained by a cut-out in the upper portion of a side wall of the inner container, opposing the dispensing mouth. The size of the cut-out may be sufficient to allow manual access to the napkins inside the inner container via the cut-out.

As described in the above, the access opening, e.g. a cut-out may be useful for grasping the first leading end of a new stack of napkins, which is to be introduced to the dispensing mouth for the initial set-up of the dispenser.

The access opening may also serve as a gripping section to remove the inner container from the outer sleeve.

When the outer sleeve includes two opposing open ends, access openings may advantageously be provided at the corresponding side walls of the inner container. The provision of access openings on opposing sides of the inner container further facilitates gripping of a leading end of a stack contained in the inner container, when located in the outer sleeve, and introducing it into the dispensing mouth.

Moreover, an access opening may be useful for providing a visual indication of the need for refilling (e.g. when the supporting surface is visible through the access opening.)

According to what is proposed herein, the supporting surface is vertically movable inside the inner container between a lower position adjacent the bottom wall of the inner container, and an upper position adjacent the dispensing opening of the inner container. The supporting surface is biased towards the dispensing opening of the container, and the upper position of the supporting surface is determined by at least one horizontally extending tab arranged in the inner container.

The supporting surface may be biased using any conventional biasing means. In a particular embodiment, the supporting surface is biased towards the dispensing opening of the container by a spring, such as a conical spring.

The spring may advantageously be arranged between the supporting surface and the bottom surface of the container. In particular embodiments, if using a conical spring, the spring may be arranged with its largest end surface facing towards the bottom wall of the inner container, and its smallest end surface facing towards the supporting surface. This arrangement may enhance the stability of the supporting surface. However, the spring may also be arranged with its largest end surface facing towards the supporting surface.

The bottom wall of the inner container is advantageously provided with a track into which one end of the spring, for example the large end surface of the conical spring, will fit. In a similar manner, the underside of the supporting surface may be provided with a corresponding track arranged to fit the opposite end of the spring, i.e. the smaller end surface of the conical spring. Fitting the spring end surfaces into tracks will prevent said spring end surfaces from slipping on the biasing surfaces and thereby stabilize the biased movement of the supporting surface between the lower and upper positions.

The upper position of the supporting surface may be determined by at least one, horizontally extending tab, arranged in the inner container. When the dispenser is completely filled with a stack of napkins, the supporting surface will be pressed downwardly, against the bias, to assume its lower position adjacent the bottom surface of the inner container. A top panel of the stack will abut the tab, and thereby restrict the upward movement of the supporting surface.

As napkins are dispensed, the height of the stack contained in the dispenser will diminish, allowing the supporting surface to move vertically upwards. Accordingly, the top panel of the stack will continuously abut the tab.

Should the dispenser be completely emptied, the supporting surface will eventually abut the tab, and reach its upper position.

Since the top panel of the stack will always be located at the position of the tabs, the vertical distance between the top panel of the stack and the dispensing mouth will always be constant. This means that a specific length of the leading end of the uppermost sheet will extend from the top panel and out via the dispensing mouth to be presented to a user. By selection of the vertical distance between the tabs and the dispensing mouth, a suitable length for upright presentation of the end of the sheet may be achieved.

For some useful applications, the vertical distance between the upper position of the supporting surface and the dispensing mouth, (in certain embodiments between the tab and the dispensing mouth may be at least 1 cm, at least 2 cm, or at least 3 cm.

In accordance with what is proposed herein, a space will be provided between the dispensing mouth and the uppermost panel of the stack. Accordingly, it is ensured that the stack is not clamped against the dispensing mouth, which would risk complicating the removal of napkins from the stack.

Advantageously, at least two tabs may be provided, extending from opposing sides of the inner container. In particular embodiments, the two tabs may extend from the opposing sides of the container being arranged in parallel with the dispensing mouth, when the inner container is positioned in the outer sleeve. The use of two tabs provides greater hold back security, for securing that only the uppermost napkin is withdrawn from the stack upon pulling a leading end thereof.

Also, more than two tabs may be arranged, for example four or more tabs.

The tabs may be arranged on opposing sides of the container, and diagonally over the supporting surface. This arrangement might facilitate the introduction of a stack of napkins in the inner container, past the tabs.

The tab may be arranged at an upper end portion of a side wall of the inner dispenser.

The tabs will extend partially over the dispensing opening of the inner container. A suitable extension may be determined for a specific dispenser, to achieve sufficient hold-back of the stack of napkins while allowing for withdrawal of the topmost napkin. Hence, the extension may depend e.g. on the bias, on the dimensions of the dispenser and the napkins to be introduced therein, and/or the materials of the tabs. The extension may be about 1-4 cm from the side walls.

The tabs will also have a length extension along the inner container side walls. The tabs could extend over substantially the entire inner container side walls. However, in particular embodiments, the tabs are arranged to extend over only a portion of the container side walls, e.g. 3-12 cm.

The size and arrangement of the tabs should be selected in relation to the spring force obtained from the bias, so as to ensure that the upper panel of a stack of napkins is kept in position when a napkin is withdrawn from the dispenser, and avoid that multiple napkins are unintentionally withdrawn.

However, the size and arrangement of the tabs should also allow the refill of the inner container with new napkins via the dispensing opening.

In accordance with an embodiment, the tabs may be slightly flexible, whereby introduction of napkins past the tabs and into the inner container might be facilitated.

In accordance with another embodiment, the tabs may be rigid. In this case, the tabs could be fixedly arranged at the inner container side walls, but then the size and arrangement of the tabs must allow for introduction of napkins without the napkins becoming wrinkled. This will pose quite severe restrictions on the tabs arrangements available.

Alternatively, the tabs may be rigid, but be movably arranged in the inner container.

The rigid tabs may be movably arranged in that they are pivotably arranged in relation to the inner container. Hence, the rigid tabs may be movable from a holding position, in which the tabs extend at least horizontally over a portion of the dispensing opening, and a refill position, in which the tabs are directed away from the dispensing opening.

Alternatively, the rigid tabs may be movably arranged in that they are removably arranged in relation to the inner container. To this end, the tabs may be fastened to the inner container using a releasable fastening arrangement, e.g. a snap-fit locking arrangement. Hence, one or more rigid tabs may be removed from the inner container for refilling thereof with napkins, and then reattached to the inner container before introduction thereof into the outer sleeve.

Advantageously, the dispenser may include releasable locking means for releasably locking the inner container when received in the outer sleeve. Accordingly, the risk that the inner container will tend to fall out of the sleeve when the dispenser is handled is avoided.

Many types of locking means suitable for connecting an inner container with an outer sleeve may be envisaged.

In particular embodiments, the locking means may be arranged between the bottom wall of the inner container and a corresponding bottom wall of the outer sleeve. Hence, the locking means may be arranged at the bottom of the dispenser, where it will not be visible during normal use of the dispenser.

Advantageously, the locking means may include a resilient tongue formed in said bottom wall of the inner container, and a corresponding groove formed in the corresponding bottom wall of the outer sleeve. Hence, the resilient tongue may snap-fit into the groove for locking of the inner container inside the outer sleeve.

The groove may form an opening through the bottom wall of the outer sleeve. Accordingly the tongue, when fit into the groove, is accessible from the bottom side of the dispenser, enabling release of the tongue from the groove by manually pressing the tongue out of the groove from the bottom side of the dispenser.

Advantageously, the locking means may be centrally arranged along the length of the inner container and outer sleeve along the insertion direction. This is particularly useful when the outer sleeve includes two open ends, and the inner container is insertable into the sleeve from two opposite insertion directions, in which case the locking means will work regardless of which insertion direction is used.

The outer sleeve may be provided with fastening means, by which the dispenser may be attached to a surface, in particular a wall or a surface of a kitchen cabinet. Fastening means such as adhesive strips, screws, Velcro fasteners, clips or other fastening means can be used.

Advantageously, the bottom surface of the outer sleeve may be furnished with one or more supporting means, such as e.g. rubber feet, or feet lined with an upholstered material to prevent scratching of any surface onto which the dispenser is placed.

When the dispenser is being used, a stack of interfolded napkins is placed on the supporting surface of the bottom wall. The stack of interfolded napkins may have a rectangular shape with rectangular or square bottom surface corresponding to the trailing panel of the last napkin in the stack. The stack may have any suitable dimensions such as any suitable height, width and length. The width and length dimensions are defined by the dimensions of the bottom surface of the stack and the height is measured perpendicular to the bottom surface and is determined by the number of napkins in the stack as well as the number of plies and panels in each napkin. The individual napkins may include one or more plies or layers and may have been folded into two or more panels.

The napkins may be any kind of household napkins, wipes, paper towels, etc. The material may be a fibrous material of any suitable kind such as cellulose based paper materials, with or without admixture of man-made fibres, binders and fillers. The napkins may include only man-made fibres. However, it is usually desired that a napkin has some degree of absorbency or that it at least is wettable. If the fibrous material contains a large proportion of fibres of a hydrophobic character implying that the fibres are non-wettable, it may be suitable to treat the material with a wetting agent. Wetting agents and other additives are well known to the person skilled in the art and will not be further discussed herein. The napkins may have any suitable shape and/or size and may be embossed, perforated, printed and dyed if desired. The napkins may be single-ply sheets of material or may include two or more plies of the same or different materials. In the stack the napkins are folded at least once in order to obtain an interfolded arrangement with interconnected panels. However, the napkins may be additionally folded in order to reduce their planar size to a practical dimension as is well known in the art. Accordingly, any type of interfolding of the napkins may be used, as known in the art.

Numerous different materials and combinations of materials may be selected to provide a dispenser as described herein.

The outer sleeve may be formed from a band-shaped material, for example from a metallic band-shaped material, having a width substantially equal to the length of the inner container along the insertion direction. The dispensing mouth may be defined between the ends of the band shaped material. The ends may be bent upwardly at the dispensing mouth to provide vertically extending support portions.

Suitable metallic materials could be aluminium and/or stainless steel.

Alternatively, the outer sleeve may be formed form a plastic band-shaped material.

In yet another alternative, the outer sleeve may be made from an extruded metallic material, for example aluminium and/or stainless steel, or from a moulded or extruded plastic material, or from wood e.g. pressed or cut out wood.

The inner container may for example be formed from a plastic material, a metal material, or wood.

It is noteworthy that the dispenser according to embodiments of the present invention is intended for multiple use. In other words, the dispenser is intended to be refilled, rather than disposed, when empty.

The dispenser arrangement according to embodiments of the invention has a simple construction and may be made from inexpensive and readily available materials. Moreover, the dispenser arrangement has a reliable function and will not damage the dispensed napkins.

Further, the dispenser may be manufactured having a tidy and fancy appearance by choosing exclusive materials, such as brushed steel, aluminum or wood. This may be desirable when the dispenser is intended to be used in formal and elegant environments.

BRIEF DESCRIPTION OF THE DRAWINGS

Embodiments of the invention will now be described by way of example only and with reference to the accompanying drawings, of which.

DETAILED DESCRIPTION OF PARTICULAR EMBODIMENTS

Figure 1A:
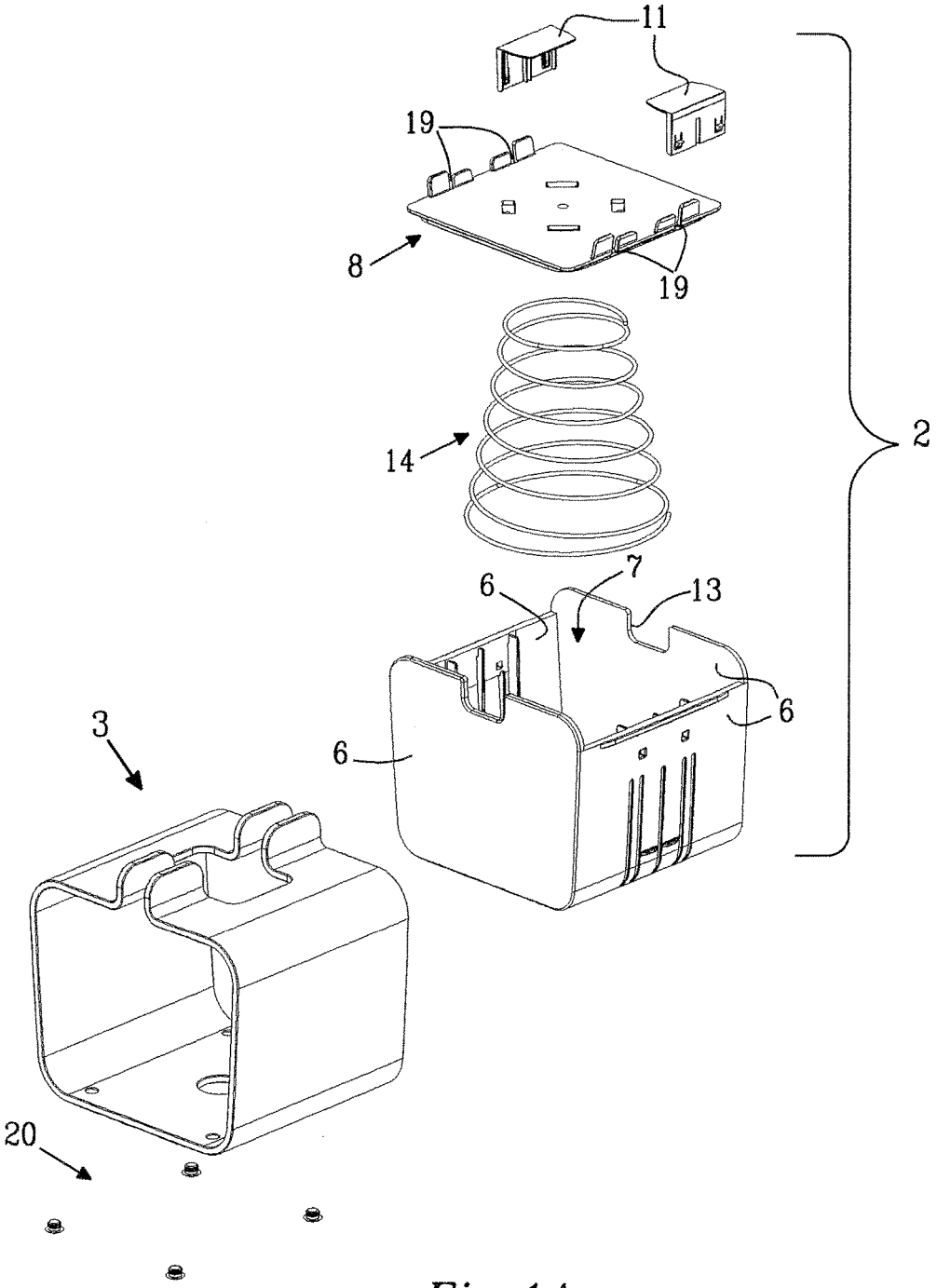
FIG. 1A is an exploded view of the dispenser illustrated in FIG. 1.
Figure 1:
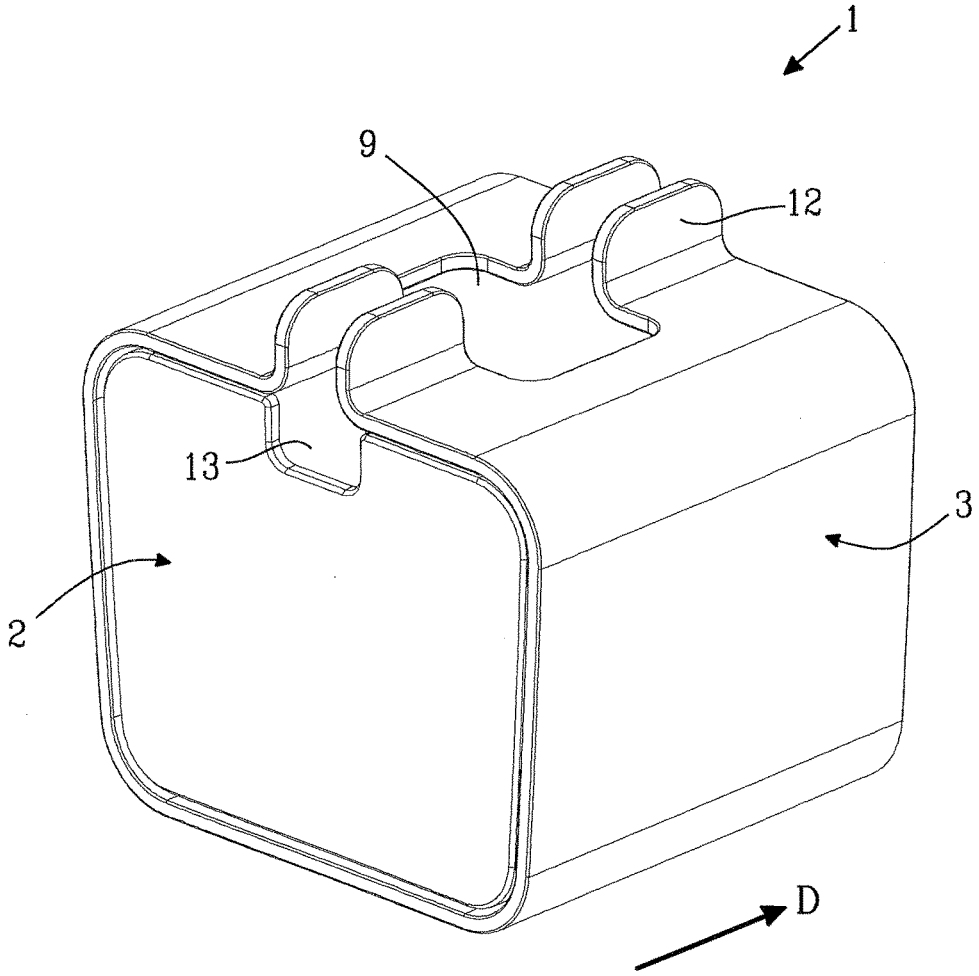
FIG. 1 illustrates an embodiment of a dispenser for dispensing interfolded napkins.

In the following, different embodiments of the present disclosure will be described by reference to the attached Figures. Identical or similar features will be denoted by the same reference numerals and repeated description thereof will be avoided.

FIGS. 1 to 5 show embodiments of the dispenser 1 of the present application.

The dispenser 1 includes an outer sleeve 3 and an inner container 2. The inner container 2 can be inserted into the outer sleeve 3, as it is shown in the schematic perspective diagram of FIG. 1. The inner container 2 of the dispenser 1 includes a dispensing opening 7 for dispensing e.g. interfolded napkins which are contained inside the inner container 2. The outer sleeve 3 includes a dispensing mouth 9 which is aligned with the dispensing opening 7 of the inner container 2 when the inner container 2 is inserted into the outer sleeve 3. This enables a reliable dispensing process of the interfolded napkins from the inner container 2.

The outer sleeve 3 forms an open end 10 through which the inner container is insertable into the outer sleeve 3 along an insertion direction D, extending in parallel with the dispensing mouth 9. The dispensing opening 7 of the inner container 2 is substantially larger than the dispensing mouth 9 of the outer sleeve 3 such that the dispensing opening 7 of the inner container 2 will not influence the dispensing characteristics of the dispensing mouth 9 of the outer sleeve 3, but simply enables dispensing of the napkins through the aligned dispensing opening 7 and dispensing mouth 9 when the inner container 2 is received in the outer sleeve 3.

The dispensing mouth 9 of the outer sleeve 3 is open towards the open end 10 of the outer sleeve 3. Accordingly, the inner container 2 may be inserted into the outer sleeve 3, while a leading end of a stack of napkins contained in the inner container 2 is allowed to protrude vertically from the dispensing opening 7 of the inner container 2. In this case, the protruding leading end of the stack may be introduced into the dispensing mouth 9 via the open end thereof as the inner container 2 is introduced into the outer sleeve 2 via the open end 10 thereof. Hence, set-up of the dispenser in a ready-to use configuration with a leading end of the stack being present in the dispensing mouth 9 is facilitated.

In the illustrated embodiment, the outer sleeve 3 forms two opposing open ends 10, and the dispensing mouth 9 is open towards both open ends 10 of the sleeve 3. Accordingly, the inner container 2 may be introduced into the outer sleeve 3 along any one of two opposing insertion directions D.

However, it will be understood that other embodiments, displaying only one open end of the sleeve one and corresponding opening of the dispensing mouth 9, may also be envisaged.

Figure 2:
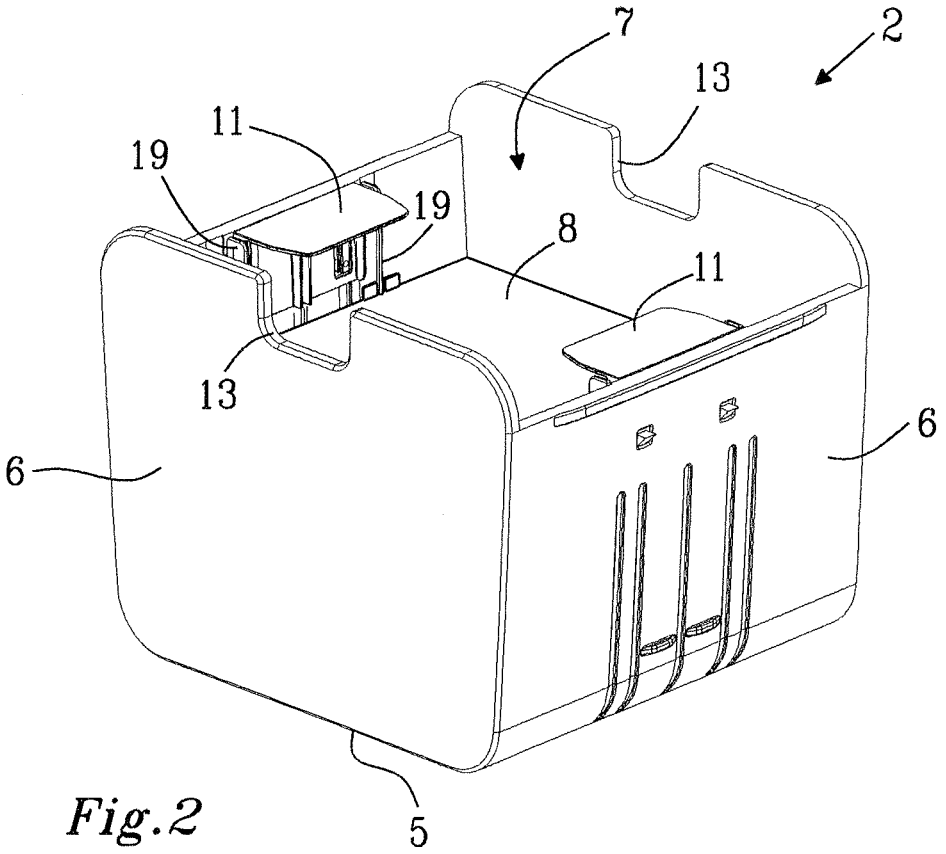
FIG. 2 illustrates a first embodiment of an inner container which may be used with the embodiment of a dispenser of FIG. 1.

FIG. 2 shows a perspective view of the inner container 2. As can be seen, the inner container 2 has a bottom wall 5, and side walls 6 which extend in the vertical direction perpendicular to the bottom wall 5. The side walls 6 define the dispensing opening 7, which is located opposite the bottom wall 5. A supporting surface 8 for supporting a stack of interfolded napkins extends in the horizontal plane inside the inner container 2. Typically, the stack of napkins to be dispensed is held in the volume defined by the side walls 6 and the supporting surface 8.

The supporting surface 8 is biased towards the dispensing opening 7 by means of a spring 14, such as a conical spring as seen in FIG. 1A. The spring 14 is arranged between the bottom wall 5 and the lower surface of the supporting surface 8, such that the largest end surface of the conical spring 14 faces towards the bottom wall 5 of the inner container 2, and its smallest end surface faces towards the supporting surface 8. The supporting surface 8 is vertically movable inside the inner container 2 by means of said biasing spring 14. The supporting surface 8 moves between a lower position adjacent the bottom wall 5, and an upper position adjacent the dispensing opening 7.

One end of the spring 14, for example the large end surface of the conical spring, is fitted into a track 17 provided on the bottom wall 5 of the inner container 2. The opposite end of the spring 14, i.e. the smaller end surface of a conical spring is fitted into a corresponding track 17 arranged on the underside of the supporting surface 8. Fitting the spring end surfaces into tracks 17 will prevent said spring end surfaces from slipping on the biasing surfaces and thereby stabilize the biased movement of the supporting surface 8 between the lower and upper positions.

The outline of the supporting surface 8 is provided with one or more protrusions 18 protruding from said outline in the horizontal direction into vertically arranged rails 19 provided on one or more side walls 6 of the inner container 2. Said protrusions 18 and rails 19 serve to guide the vertical movement of the supporting surface 8 between the lower and upper positions inside the inner container 2.

The upper position for the supporting surface 8 is determined by one or more tabs 11 extending in the horizontal direction from the side walls 6 of the inner container 2. In FIG. 2, it is seen how two tabs 11 extend from the upper edges of opposing side walls 6 and abut the upper side of the uppermost panel of a stack of napkins. The tabs 11 restrict the upward movement of the supporting surface 8, and ensure that the uppermost napkin is kept in position when it is withdrawn from the dispenser 1. The tabs 11 will also prevent that multiple napkins are unintentionally withdrawn at the same time. As napkins are dispensed, the height of the stack contained in the dispenser 1 will diminish, allowing the supporting surface 8 to move vertically upwards. When all napkins have been withdrawn from the dispenser 1 the tabs 11 will abut the supporting surface 8.

Figure 3A:
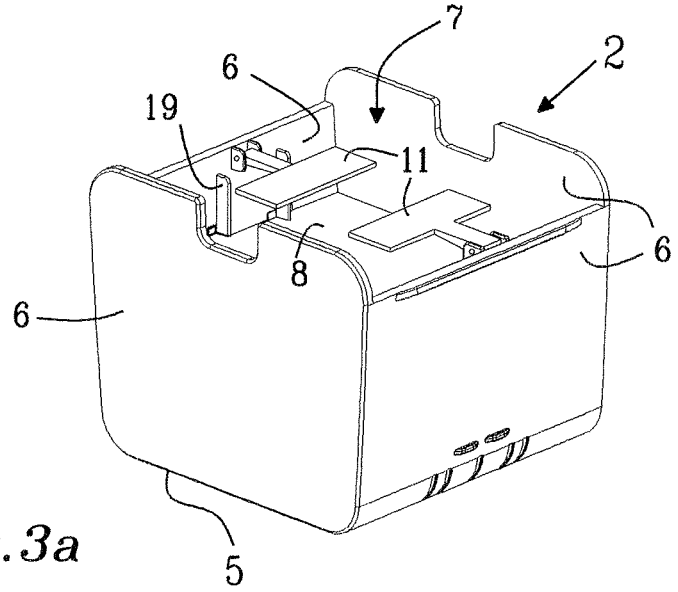
FIG. 3*a* illustrates a second embodiment of an inner container which may be used with the embodiment of a dispenser of FIG. 1, when in a holding position.
Figure 3B:
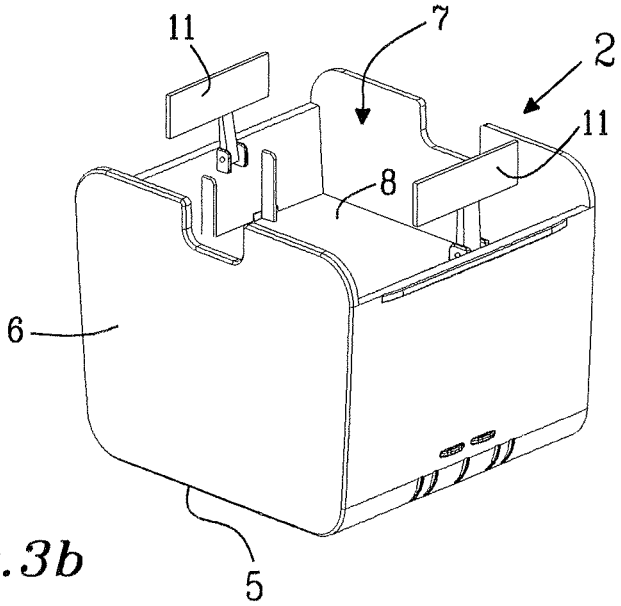
FIG. 3*b* illustrates the second embodiment of FIG. 3*a*, when in a refill position.

In an alternative embodiment, illustrated in FIGS. 3*a* and 3*b*, the tabs 11 are pivotably arranged in relation to the inner container 2. In this embodiment, the tabs 11 are movable from a holding position in which the tabs 11 extend at least horizontally over a portion of the dispensing opening 7, and a refill position, in which the tabs 11 are directed away from the dispensing opening 7. This arrangement with pivotable tabs 11 will facilitate the loading of a stack of napkins into the inner container 2. FIG. 3*b* shows an embodiment wherein the pivotable tabs 11 are in a refill position. In a further embodiment, said tabs 11 may be completely removed from the side walls 6 of the inner container 2 to further facilitate the refilling of napkins into the container 2.

In the illustrated embodiment, two tabs 11 are pivotably arranged at the upper end surfaces of the side walls 6. The fastening arrangement includes snap-lock elements, which are snapped to position at the upper end surfaces of the side walls 6. Moreover, in this embodiment, the fastening arrangement includes hinges, formed by the snap-lock elements in combination with the pivotable tabs 11. The tabs 11 extend outwardly from the fastening arrangement along a stem portion, having a relatively narrow length as seen along the corresponding side wall 6. The stem portion is connected to an abutment portion, which is elongate, and which extends along the length of the corresponding side wall 6.

In FIG. 3*a* it is seen how the tabs 11 as a whole, form an angle of about 45 degrees with the vertical plane including the side wall 6 to which the tabs is attached. Accordingly, the tabs 11 extend in a horizontal direction over the dispensing opening 7 so as to retain a stack of napkins held inside the inner container 2.

In particular embodiments, the tabs 11 are releasably lockable in the holding position of FIG. 3*a*, such that they may resist any pull forces from a napkin being withdrawn from the stack.

In FIG. 3*b*, it is seen how the tabs 11 are directed away from the dispensing opening 7, when the inner container is in a refill position. The entire dispening opening 7, as outlined by the side walls 6, is readily available for easy refill of napkins.

It will be understood that numerous alternative embodiments are available, for example as it comes to the size and shape of the pivotable tabs.

Figure 4A:
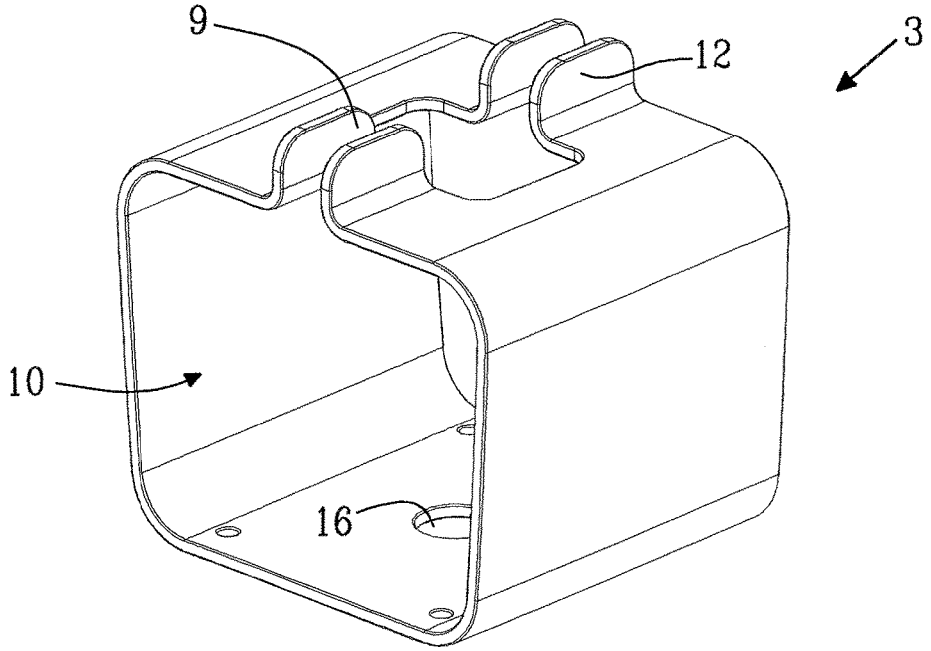
FIGS. 4A and 4B illustrate the outer sleeve of the dispenser illustrated in FIG. 1.
Figure 4B:
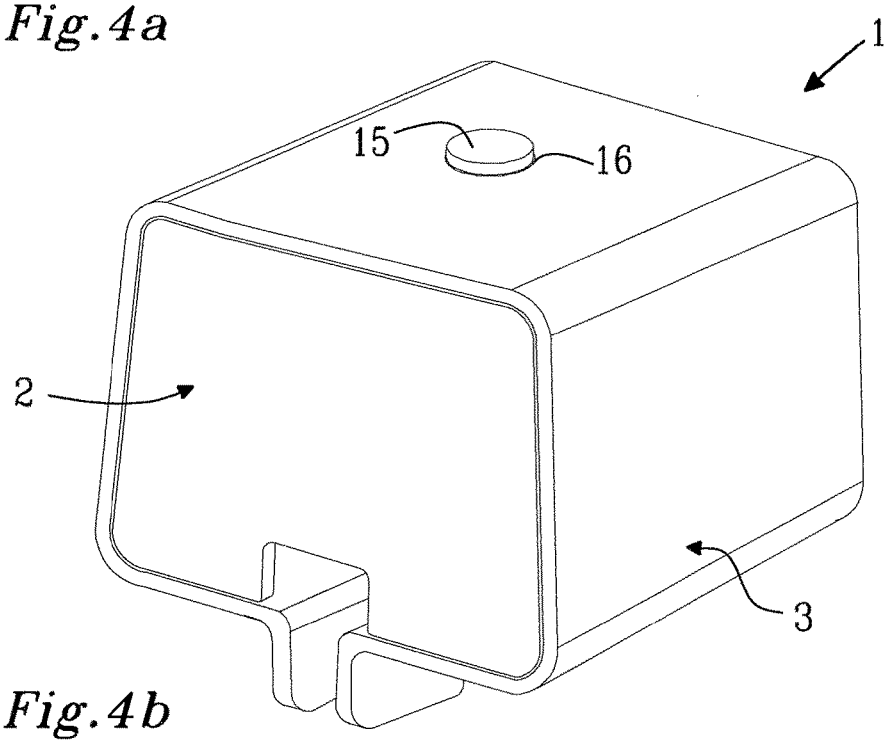

FIG. 4 shows the outer sleeve 3 in a schematic perspective drawing. As will be appreciated, the outer sleeve 3 is, in the form shown in the Figures, for example made from an extruded metallic material, in particular a molded aluminum or stainless steel material. In a different embodiment, the outer sleeve 3 may be made from an extruded plastic material. In particular the inner shape of the outer sleeve 3 corresponds to the outer shape of the inner container 2, as becomes immediately apparent from the Figures, in particular FIG. 1.

In another advantageous embodiment, the outer sleeve 3 is made from a band-shaped material which is bent in the form shown in the Figures. The band-shaped material which may be used to manufacture the outer sleeve 3 can be provided in the form of a metal band, in particular an aluminum and/or stainless steel band, or in the form of a band made from a rigid plastic material.

Advantageously the band-shaped material has a width that is substantially equal to the length of the inner container 2 in the direction D.

Figure 5:
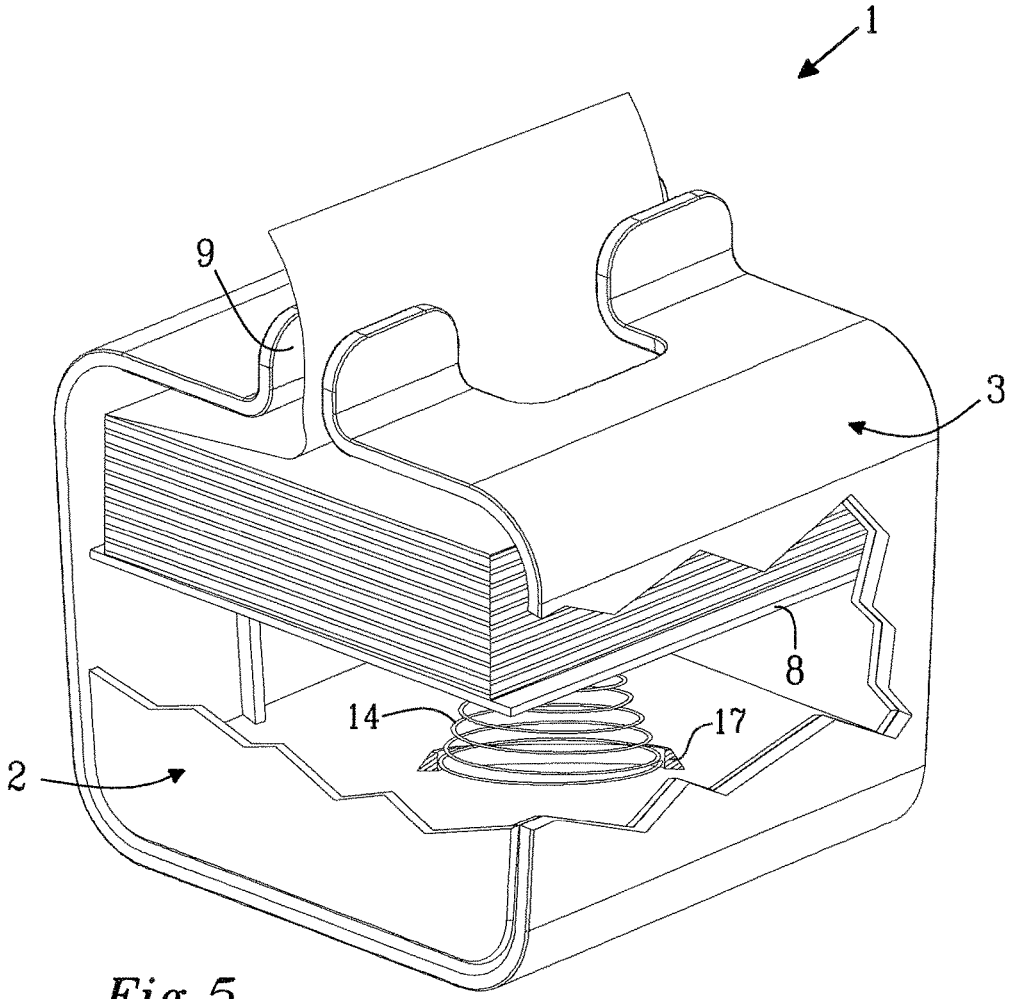
FIG. 5 illustrates the dispenser of FIG. 1 when in a ready-to-use position including a stack of napkins.

The outer sleeve 3 includes a dispensing mouth 9, i.e. an opening through which items are dispensed. As seen in FIG. 5, the dispensing mouth 9 is positioned over the items inside the inner container 2, so as to be aligned with a leading end of the stack of napkins protruding from said dispensing opening 7, when the inner container 2 is located inside the outer sleeve 3.

The biased vertical movement of the supporting surface 8 supporting the stack of napkins towards the dispensing opening 7, automatically positions the protruding leading end from the stack inside the dispensing mouth 9 with a constant length of the leading end extending through the dispensing mouth 9.

To further facilitate the presentation of the leading end present in the dispensing opening 7 inside the dispensing mouth 9, the dispensing mouth includes vertically upwardly protruding edges 12. The vertically upwardly protruding edges 12 enable the napkin to assume an up-right position as seen in FIG. 5.

As illustrated in FIG. 4, the dispensing mouth 9 is advantageously provided with a portion having a greater width extending in a direction perpendicular to the insertion direction D, than the other portions of the dispensing mouth 9. Such a wider portion arranged in the dispensing mouth 9 may facilitate gripping of the napkin, or facilitate the gripping of a leading end of the uppermost napkin when the leading end is lying flatly down on the stack located inside the inner container 2.

The side walls 6 of the inner container 2 need not necessarily be closed, but may be provided with openings or slots. In FIG. 2, it can be seen that the upper regions of the side walls 6 of the inner container 2 are provided with an access opening 13 arranged adjacent to the inner periphery of the outer sleeve 3. The access openings 13 may serve as gripping sections to remove the inner container from the outer sleeve 3. The provision of access openings 13 on both sides of the inner container 2 has the advantage that it does not matter in which orientation the inner container 2 is inserted into the outer sleeve 3, but the user can grip and withdraw the inner container 2 from the outer sleeve 3 in both possible directions.

Furthermore, the location of an access opening 13 adjacent the dispensing mouth may also facilitate the gripping of a leading end of a new stack of napkins, and the introduction of said leading end through the dispensing mouth 9.

A further reason for providing slots or openings in the side walls 6 could be to observe the filling level of napkins inside the inner container 2 (not shown).

A releasable locking means for releasably locking the inner container 2 to the outer sleeve 3 is arranged at the bottom of the dispenser 1. FIGS. 1 to 4 illustrate one type of locking means that may advantageously be used in the dispenser of the present application. The releasable locking means is centrally arranged along the length between the bottom wall 5 of the inner container 2 and the bottom wall of the outer sleeve 3. A resilient tongue 15 is arranged in the bottom wall 5 of the inner container 2. Said resilient tongue 15 snap-fits into an opening 16 arranged through the corresponding bottom wall of the outer sleeve 3.

When the inner container 2 is locked to the outer sleeve 3, the resilient tongue 15 is accessible from the bottom side of the dispenser 1, enabling release of the tongue 15 from the opening 16 by manually pressing the tongue 15 out of the opening 16 from the bottom side of the dispenser 1.

In the embodiments shown, the outer sleeve 3 is preferably made from a metal material, preferably from aluminum or stainless steel, which is extruded and cut into the respective form. However, other materials can also be used which are rigid enough to perform the function of receiving the inner container 2, in particular metal band materials, extruded plastic materials, wooden materials and laminates thereof.

The inner container 2 can be made from a wooden material, a plastic material or laminates thereof. As to the plastic material, a transparent or see-through plastic material might be of particular benefit in some applications. Naturally, the inner container 2 can be made from the same material as the outer shell, depending on specific design considerations.

The bottom surface of the outer sleeve is furnished with one or more supporting means 20, such as e.g. rubber feet, or feet lined with an upholstered material to prevent scratching of any surface onto which the dispenser is placed.

In the following, the process of filling the dispenser 1 with napkins will be described. In particular, napkins are provided in the form of a stack, which contains separate napkins that are interfolded such that, when removing the top napkin, the subsequent napkin will automatically present its leading end. The napkins used with the dispenser 1 may have any suitable size which fits into the volume defined by the inner container 2.

The stack of interfolded napkins 5 is inserted into the inner container 2, while pushing the supportive surface 8 towards its lowest position adjacent the bottom wall 5. The stack of napkins is placed on top of the supportive surface 8, such that the tabs 11 extending from the upper edges of opposing side walls 6 abut the upper side of the uppermost panel of a stack of napkins.

According to embodiments, such as for example the embodiment illustrated in FIG. 2, the tabs 11 may be slightly flexible, such that the introduction of napkins past the tabs 11 and into the inner container 2 might be facilitated. The tabs 11 restrict the upward movement of the supporting surface 8, and ensure that the uppermost napkin is kept in position when it is withdrawn from the dispenser 1. The tabs 11 will also prevent that multiple napkins are unintentionally withdrawn at the same time.

From the Figures it is seen that the top panel of the stack will always be located at the position of the tabs 11, such that the vertical distance between the top panel of the stack and the dispensing mouth 9 will always be constant. This means that a specific length of the leading end of the uppermost sheet will extend from the top panel and out via the dispensing mouth 9 to be presented to a user. By selection of the vertical distance between the tabs 11 and the dispensing mouth 9, a suitable length for upright presentation of the end of the sheet may be achieved.

According to other embodiments, for example the embodiment of FIGS. 3*a* and 3*b*, the loading of the stack of napkins is facilitated in that the inner container 2 is provided with movable tabs 11, in particular with pivotable tabs 11. When a stack of napkins is loaded into a container 2 provided with pivotable tabs 11, said pivotable tabs 11 are placed in a refill position, wherein the tabs 11 are directed away from the dispensing opening 7 (see FIG. 3*b*). Thereafter, the supportive surface 8 is pushed towards its lowest position adjacent the bottom wall 5, while the stack of napkins is placed on top of the supportive surface 8. The stack is manually held back while he pivotable tabs are repositioned into the holding position, in which the tabs abut the upper side of the uppermost panel of a stack of napkins (see FIG. 3*a*). Advantageously, the tabs are lockable in said holding position.

In an alternative embodiment, the tabs may be completely removed before loading the stack of napkins onto the supportive surface 8. Thereafter, the tabs are reattached to the inner container using a releasable fastening arrangement, e.g. a snap-fit locking arrangement (not shown).

As napkins are dispensed, the height of the stack contained in the dispenser 1 will diminish, allowing the supporting surface 8 to move vertically upwards. When all napkins have been withdrawn from the dispenser 1 the tabs 11 will abut the supporting surface 8.

After the stack of napkins has been loaded into the inner container 2, the inner container 2 is inserted into the outer sleeve 3 along the insertion direction D extending in parallel with the dispensing mouth 9, such that when inserted in the outer sleeve 3, the dispensing opening 7 of the container 2 is aligned with the dispensing mouth 9 of the outer sleeve 3.

As described in the above, the inner container 2 may be inserted into the outer sleeve 3, while a leading end of a stack of napkins contained in the inner container 2 is allowed to protrude vertically from the dispensing opening 7 of the inner container 2. Hence, the protruding leading end of the stack is introduced into the dispensing mouth 9 via the open end thereof as the inner container 2 is introduced into the outer sleeve 2 via the open end thereof, enabling easy set-up of the dispenser.

The insertion of the inner container 2 into the outer sleeve 3 is facilitated by means of access openings 13 provided on two opposing side walls 6 of the inner container 2, in that said access openings 13 enable the user to grip the inner container 2 using the access openings 13 and insert said container 2 into the outer sleeve 3 from any direction.

Moreover, the access openings 13 are useful in that they may facilitate gripping of the leading end of a new stack of napkins, contained in the inner container 2, before introduction of the inner container 2 into the outer sleeve 3.

Also, once the inner container 2 is inserted into the outer sleeve 3, the access openings 13 enable the user to grip a leading end of a new stack of napkins and introduce said leading end through the dispensing mouth 9. Such introduction is facilitated by means of the access openings 13 on the side walls 6, through which the user may insert two or more fingers to position the leading end of the stack of napkins into the dispensing mouth 9. Manipulation of the leading end of the stack via the access openings 13 may hence provide an alternative way of setting the dispenser in a ready-to use condition. In particular, this way may be preferred in cases when the stack contained in the dispenser is interrupted, such that a new napkin does not automatically follow a withdrawn napkin.

In the illustrated embodiment, the access openings 13 include cut-outs in the side walls of the inner dispenser.

The dispenser further includes a releasable locking means for releasably locking the inner container 2 inside the outer sleeve 3. In the illustrated embodiment, the releasable locking means centrally arranged between the bottom wall 5 of the inner container 2 and the bottom wall of the outer sleeve 3, will automatically enter into a locking position when the inner container 2 is inserted into the outer sleeve 3. The resilient tongue 15 arranged in the bottom wall 5 of the inner container 2 will snap-fit into the opening 16 arranged through the corresponding bottom wall of the outer sleeve 3.

Removal of the inner container 2 from the outer sleeve 3 is enabled by manually pressing the tongue 15 out of the opening 16 from the bottom side of the dispenser 1, and simultaneously gripping the inner container 2, for example by means of the access openings 13 provided on either side wall 6 of the container 2, and pulling the inner container 2 out of the outer sleeve 3 along the insertion direction D.

Although the present invention has been described with reference to various embodiments, those skilled in the art will recognize that changes may be made without departing from the scope of the invention. It is intended that the detailed description be regarded as illustrative and that the appended claims including all the equivalents are intended to define the scope of the invention.

The invention claimed is:

1. A dispenser for interfolded napkins, comprising:

an inner container having:

a bottom wall extending in a horizontal plane, side walls extending from the bottom wall in a vertical direction perpendicular thereto, and a dispensing opening opposite the bottom wall, the side walls of the inner container surrounding a supporting surface for supporting a stack of interfolded napkins; and an outer sleeve comprising:

at least one open end being arranged to receive the inner container such that the inner container is insertable into the outer sleeve along an insertion direction extending in parallel to said horizontal plane, and a dispensing mouth that forms an open end towards said open end of the outer sleeve, wherein the dispensing opening and the dispensing mouth both extend along said insertion direction, wherein an area of the dispensing opening is larger than the dispensing mouth, and wherein, when the inner container is located in the outer sleeve, the supporting surface is biased towards the dispensing opening of the inner container and vertically movable inside the inner container between a lower position adjacent the bottom wall of the inner container, and an upper position adjacent the dispensing opening of the inner container, and at a distance from an inner periphery of the outer sleeve, forming a space between the upper position and the dispensing mouth, and wherein, at least in a region adjacent the open end of the dispensing mouth, an outer contour of upper ends of the side walls of the inner container deviates from the inner periphery of the outer sleeve, forming an access opening to the space between the upper position and the dispensing mouth, when the inner container is located inside the outer sleeve.

2. The dispenser according to claim 1, wherein said upper position is determined by at least one horizontally extending tab arranged in the inner container that contacts the stack of interfolded napkins when said stack of interfolded napkins are present in the inner container.

3. The dispenser according to claim 1, wherein the outer sleeve forms two opposite open ends, and the dispensing mouth is open towards both open ends, such that the inner container is insertable into the outer sleeve along two opposing insertion directions.

4. The dispenser according to claim 1, wherein a length of the outer sleeve along the insertion direction substantially corresponds to a length of the inner container along the insertion direction.

5. The dispenser according to claim 1, wherein the dispensing mouth has a longitudinal length of at least 75% of a length of the supporting surface extending along the insertion direction (D).

6. The dispenser according to claim 1, wherein the dispensing mouth comprises vertically upwardly protruding edges, for supporting a leading end of a napkin when present in the dispensing opening.

7. The dispenser according to claim 1, wherein the dispensing mouth at least partly having a selected width, in a horizontal direction perpendicular to the insertion direction, said width being in a range of 1 to 3 cm.

8. The dispenser according to claim 7, wherein the dispensing mouth forms at least one portion having another width, greater than said selected width.

9. The dispenser according to claim 1, wherein the supporting surface is biased towards the dispensing opening of the inner container by a spring.

10. The dispenser according to claim 9, wherein the spring is arranged between the supporting surface and the bottom wall of the inner container.

11. The dispenser according to claim 2, wherein said tab is flexible.

12. The dispenser according to claim 2, wherein said tab is rigid.

13. The dispenser according to claim 2, wherein said tab is pivotably arranged in relation to the inner container so as to define a holding position, in which the tab extends at least horizontally over a portion of the dispensing opening, and a refill position, in which the tab is directed away from the dispensing opening.

14. The dispenser according to claim 2, wherein said tab is removably arranged in relation to the inner container.

15. The dispenser according to claim 2, wherein said tab is arranged in the inner container at a vertical distance from the dispensing mouth of the outer sleeve, when the inner container is located in the outer sleeve, wherein said vertical distance is at least 1 cm.

16. The dispenser according to claim 2, wherein at least two tabs are arranged on at least two opposing side walls of the inner container.

17. The dispenser according to claim 1, further comprising releasable locking means for releasably locking the inner container when received in the outer sleeve.

18. The dispenser according to claim 17, wherein said locking means is arranged between the bottom wall of the inner container and a corresponding bottom wall of the outer sleeve.

19. The dispenser according to claim 18, wherein said locking means comprises a resilient tongue formed in said bottom wall of the inner container, and a groove formed in the corresponding bottom wall of the outer sleeve.

20. The dispenser according to claim 19, wherein the groove forms an opening through the bottom wall of the outer sleeve, such that the resilient tongue, when fit into the opening is accessible from the bottom side of the dispenser, enabling release of the resilient tongue from the opening by pressing the resilient tongue out of the opening.

21. The dispenser according to claim 17, wherein said locking means is centrally arranged along a length of the inner container and outer sleeve along the insertion direction.

22. The dispenser according to claim 1, wherein the outer sleeve is formed from a metallic or plastic material having a width substantially equal to a length of the inner container along the insertion direction.

23. The dispenser according to claim 1, wherein an outline of the dispensing opening essentially corresponds to an outline of the supporting surface.

24. The dispenser according to claim 1, wherein the dispensing mouth is elongate and has a maximum length dimension extending in parallel to a pair of opposing side walls of said container.

* * * * *